US006832902B2

(12) United States Patent
Gajewski et al.

(10) Patent No.: US 6,832,902 B2
(45) Date of Patent: Dec. 21, 2004

(54) FAN WITH DRIVING GEAR

(75) Inventors: Mark Gajewski, Avila Beach, CA (US); Kurt A. Schulzman, Long Beach, CA (US)

(73) Assignee: Minka Lighting, Inc., Corona, CA (US)

( * ) Notice: Subject to any disclaimer, the term of this patent is extended or adjusted under 35 U.S.C. 154(b) by 44 days.

(21) Appl. No.: 10/172,189

(22) Filed: Jun. 14, 2002

(65) Prior Publication Data

US 2003/0231962 A1 Dec. 18, 2003

(51) Int. Cl.[7] ..... F04B 35/04

(52) U.S. Cl. ..... 417/423.3; 417/423.5; 416/5; 416/99; 416/170 R

(58) Field of Search ..... 417/53, 423.3, 417/423.1, 423.5; 416/5, 61, 99, 110, 170 R; 310/62, 63, 68 R, 71; 476/64

(56) References Cited

U.S. PATENT DOCUMENTS

| | | | | |
|---|---|---|---|---|
| 314,775 A | * | 3/1885 | Bailey | 416/110 |
| 455,660 A | | 7/1891 | Cooper | |
| 532,789 A | | 1/1895 | Ketcher | |
| 597,588 A | | 1/1898 | Wood | |
| 741,107 A | * | 10/1903 | Burnes | 416/170 R |
| 776,026 A | | 11/1904 | Jacobson | |
| 816,759 A | | 4/1906 | Stowe | |
| 1,056,668 A | | 3/1913 | Happich, Jr. | |
| 1,094,540 A | | 4/1914 | Dilg | |
| 1,115,479 A | | 11/1914 | Ayres et al. | |
| 1,150,313 A | * | 8/1915 | Stauffer et al. | 416/170 R |
| 1,224,218 A | | 5/1917 | Scheibe | |
| 1,226,076 A | | 5/1917 | Jennings | |
| 1,227,291 A | | 5/1917 | Miller | |
| 1,267,752 A | | 5/1918 | Finch | |
| 1,270,832 A | | 7/1918 | Jennings | |
| 1,295,618 A | | 2/1919 | Shaw | |
| 1,332,875 A | | 3/1920 | Ainsworth | |
| 1,334,781 A | | 3/1920 | Morse | |

(List continued on next page.)

FOREIGN PATENT DOCUMENTS

JP 57-110798 * 7/1982

OTHER PUBLICATIONS

U.S. Appl. Ser. No. 29/162,390, Mark Gajewski, filed Jun. 14, 2002.

U.S. Appl. Ser. No. 29/162,389, Mark Gajewski, filed Jun. 14, 2002.

U.S. Appl. No. 29/162,417, Mark Gajewski, filed Jun. 14, 2002.

U.S. Appl. No. 29/162,419, Mark Gajewski, filed Jun. 14, 2002.

Minka Lighting, Inc.; MinkaAire Two Thousand Two; Apr. 22, 2002; pp. 22, 23, Minka Lighting, Inc.; U.S.A.

AireTek™ Advertisement, 1 page, after Apr. 2002.

Preview page in Residential Lighting magazine, p. 102, Jun. 2002.

*Primary Examiner*—Charles G. Freay

(74) *Attorney, Agent, or Firm*—Jenkens & Gilchrist

(57) ABSTRACT

A ceiling fan suspended from a mounting rod and comprising a transverse support. A pair of hanging fans are distally mounted on the transverse support. A motor fixed to the mounting rod and spaced radially therefrom drives a gyro gear about an axis parallel to and spaced from the mounting rod. The gyro gear drives a central hub gear about an axis aligned with the mounting rod. The center gear is fixed to the rotatable hub coupled to the transverse support. The fan may be stopped at any point in its rotation and be pointed to direct air flow at a selection location. And the fan may be controlled by a remote control to allow a user to conveniently point the fan at any selected location.

29 Claims, 5 Drawing Sheets

U.S. PATENT DOCUMENTS

| | | | | | |
|---|---|---|---|---|---|
| 1,485,241 | A | | 2/1924 | Aronoff | |
| 1,517,623 | A | | 12/1924 | Francois | |
| 1,826,458 | A | | 10/1931 | Cooper | |
| 1,903,615 | A | | 4/1933 | Towt | |
| 2,119,398 | A | * | 5/1938 | Morse | 416/5 |
| 2,237,039 | A | | 4/1941 | Newnham | 170/173 |
| 3,033,049 | A | * | 5/1962 | Morrow | 476/64 |
| 4,391,570 | A | | 7/1983 | Stutzman | 417/353 |
| 4,471,250 | A | * | 9/1984 | Snider | 310/67 R |
| 4,560,321 | A | | 12/1985 | Kawai | 416/23 |
| 4,621,992 | A | * | 11/1986 | Angott | 417/572 |
| 4,640,668 | A | | 2/1987 | Yang | 417/354 |
| 4,687,977 | A | * | 8/1987 | Brahmavar et al. | 318/492 |
| 4,720,241 | A | | 1/1988 | Markwardt | 416/5 |
| 4,878,806 | A | | 11/1989 | Markwardt | 416/5 |
| D313,467 | S | | 1/1991 | Frampton | D23/379 |
| 5,411,372 | A | | 5/1995 | Clark | 416/110 |
| 5,443,625 | A | | 8/1995 | Schaffhausen | 95/273 |
| 5,668,920 | A | | 9/1997 | Pelonis | 392/361 |
| D408,905 | S | | 4/1999 | Hadjikyriacou | D23/378 |
| 5,951,253 | A | | 9/1999 | Gajewski | 416/214 R |
| 6,022,118 | A | | 2/2000 | Wu | 362/35 |
| 6,022,189 | A | | 2/2000 | Yu | 416/5 |
| 6,074,182 | A | | 6/2000 | Matson | 417/423.15 |
| 6,146,191 | A | | 11/2000 | Kerr, Jr. et al. | 439/537 |
| 6,158,964 | A | | 12/2000 | Gajewski | 416/244 R |
| 6,171,060 | B1 | | 1/2001 | Gajewski | 416/244 R |
| 6,250,885 | B1 | | 6/2001 | Gajewski | 416/214 R |
| D451,996 | S | | 12/2001 | Liu | D23/411 |
| 6,354,801 | B1 | | 3/2002 | Gajewski | 416/5 |
| 6,357,714 | B1 | | 3/2002 | Johnson | 248/343 |
| D456,073 | S | | 4/2002 | Frampton | D23/413 |
| 6,364,617 | B1 | | 4/2002 | Riske et al. | 416/246 |
| 6,364,638 | B1 | * | 4/2002 | Liu | 417/423.15 |

* cited by examiner

FAN WITH DRIVING GEAR

FIELD OF THE INVENTION

The field of the present invention relates to fans, and in particular ceiling fans.

BACKGROUND OF THE INVENTION

One prior art ceiling fan includes a pair of hanging fans, each comprising two or more fan blades. The two hanging fans are secured to a rotary disk, which is rotatably mounted on a central shaft secured to the ceiling. In operation, the two hanging fans are started to rotate when the switch is turned on. The reaction caused by the rotation of the two hanging fans forces the rotary disk to rotate about the central shaft. A conducting bushing is secured on the central shaft so that the bushing does not rotate when a support base, including conductors, is rotated with the disk. Electrical power is transmitted through the central axis to the conducting bushing, and then from the conducting bushing to the hanging fans through the conductors. A gear secured to the central axis engages a reduction gear mounted in a rotation retaining set secured on the rotary disk.

One significant disadvantage with that ceiling fan is that the rotation retaining set and support base, being mounted on the rotary disk, tend to cause the disk to wobble. Another disadvantage is that the entire hub of the fan rotates. Thus, a light mounted to the rotary disk would also rotate with the fans, and tend to create moving and disorienting light effects.

OBJECTS OF THE INVENTION

An object of the invention is to overcome problems associated with prior art fans.

An object of the invention is to provide a fan having one or more electrical devices, i.e., a device that is electrically powered, whether by direct current or alternating current. Another object is to provide a motor that is center mounted, for some applications. Another object is to provide a motor that is off-center mounted.

A further object is to control fan pointing by controlling operation of a motor.

Another object is to provide an apparatus having one or more electrical devices rotating about a central axis. A further object is to radially space the devices from the central axis while providing power to the devices from a location proximate to the central axis.

A still further object is to distribute the fan blades among the fan hubs and rotate the fan hubs about a stationary light while rotating the fan hubs about respective axes.

Yet another object is to provide an apparatus for circulating air. A further object is to circulate air by propelling air to create one or more streams of air. Another object is to circulate air by rotating the one or more streams of air. A further object is to selectively point one or more streams of air at one or more points in three-dimensional space.

Another object is to remotely control the direction(s) of one or more streams of air.

Other objects and advantages of the invention will be apparent to those of skill in the art.

SUMMARY OF THE INVENTION

An embodiment is directed toward a fan comprising a mounting rod and a rotatable hub rotatably mounted on the mounting rod. The rotatable hub comprises an electrical contact track. A plurality of fan blades is coupled to and rotatable with the rotatable hub. The rotatable hub is driven by a motor mounted to the mounting rod. An electrical device is electrically coupled to the electrical contact and rotatable with the rotatable hub. Power is supplied from a power supply mounted on the mounting rod and electrically coupled to the electrical contact track. Thus, the electrical device receives power from the power supply through the electrical contact track. The electrical device is preferably one or more hanging fans distally supported relative the mounting rod, wherein the fan blades are distributed among the hanging fans. A central wheel fixed to the rotatable hub is driven by a drive wheel.

For some applications, the electrical contact track comprises first and second contacts, which are preferably respectively continuous, are rotatably fixed to the rotatable hub. The power supply comprises conductors respectively contacting the first and second contacts of the electrical contact track. The motor drives the drive wheel and the drive wheel rotates about an axis radially based from and parallel to the mounting rod. The drive wheel in turn drives the central wheel about an axis aligned with the mounting rod, thereby causing the rotatable hub to rotate about the mounting rod. In some applications, the central wheel is driven directly by a motor shaft extending from the motor. As the rotatable hub rotates, the first and second contacts are rotated relative to the power supply first and second conductors. The first and second electrical devices are thus capable of receiving power from a fixedly mounted power supply while the electrical devices rotate about the mounting rod. The first and second conductors are, for some applications, spring loaded conductors that are positioned to maintain contact with the first and second contacts.

In some embodiments, rotation and orientation of the fans are controlled remotely. The hanging fan may be stopped in its rotation by the user.

Other aspects of the present invention will become apparent to those skilled in the art upon studying this disclosure.

DETAILED DESCRIPTION OF THE ILLUSTRATED EMBODIMENT

Figure 1:
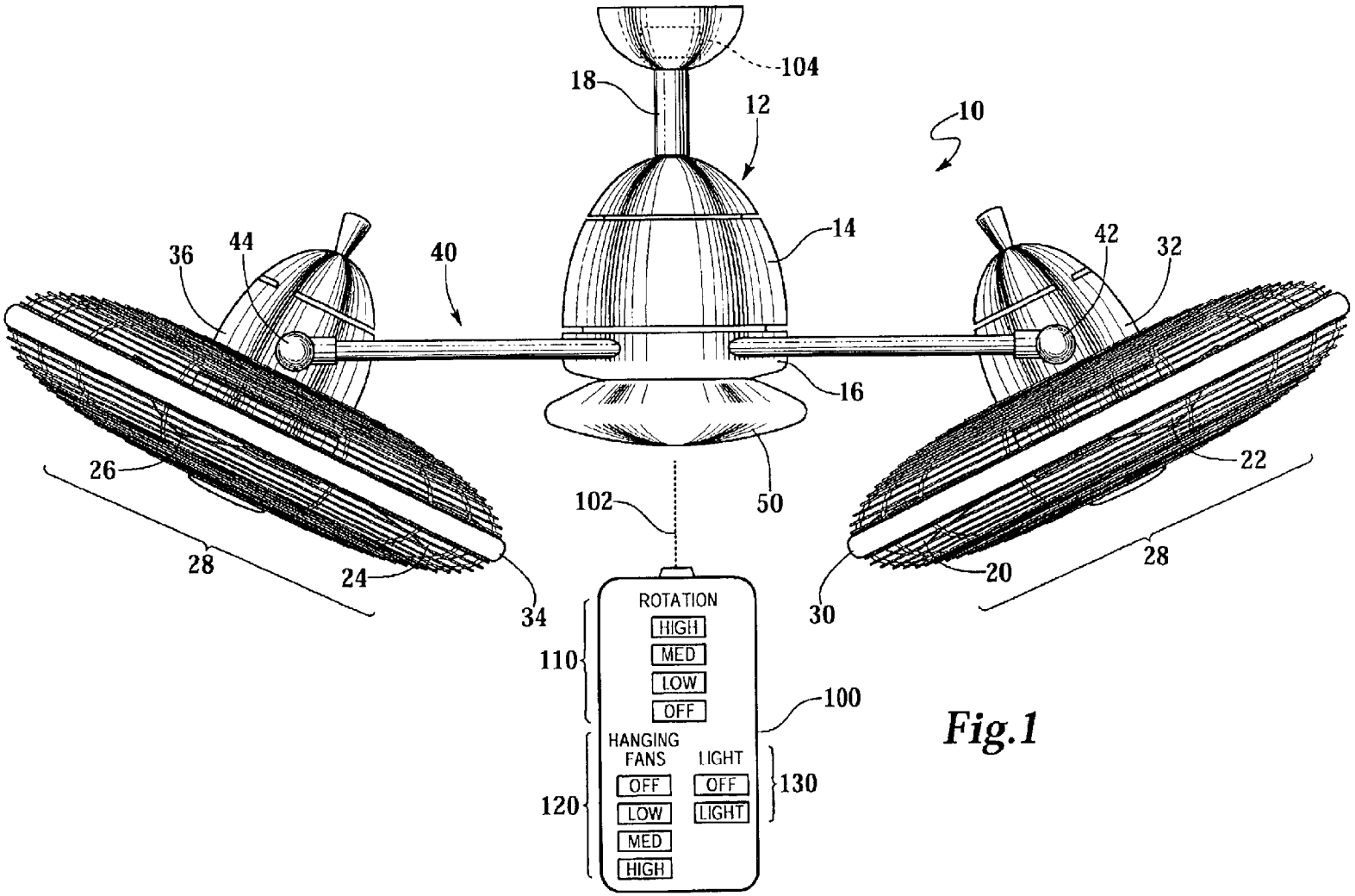
FIG. 1 shows an elevation view of a ceiling fan comprising two hanging fans distally mounted relative to a central hub that includes a housing and a light.

FIG. 1 depicts an elevation view of a fan 10. The fan 10 comprises a hub 12, which includes a housing 14 and a rotatable hub 16. The hub 12 has rotatable components which include a platform 60 having a circular electrical contact track 62, which rotates with the platform 60. A power supply 68 is located above the electrical track making contact therewith. A drive wheel 82 driven by motor 80 drives a hub wheel 84 attached to the platform such that the platform rotates. The rotatable hub 16 is connected to the platform such that when the drive wheel drives the hub wheel 84, the rotatable hub is rotated. In the embodiment shown in FIG. 1, the housing 14 is mounted stationarily on a mounting rod 18 and the rotatable hub 16 is rotatably mounted on the mounting rod 18. In the ceiling fan embodiment shown in FIG. 1 the mounting rod 18 is also referred to as a down rod, which should be generally construed to refer to various components of a down rod assembly and cap, unless indicated otherwise. The fan 10 includes one or more fan blades 20, 21, 22, 24, 25 and 26. For convenience, a plurality of fan blades will be designated by reference number 28. The plurality of fan blades 28 are coupled to and rotatable with the rotatable hub 16.

The fan 10 comprises first and second hanging fans 30 and 34, each respectively, including a hanging fan hub 32 and 36. Rotating the rotatable hub 16 moves the hanging fans 30 and 34 along a generally circular path around the mounting rod 18. More generally, the fans 30 and 34 may be moved along any predefined path. In FIG. 1, the predefined path is the circular path defined by rotating the fans at constant radii about the mounting rod. The one or more fan blades 20, 21 22, 24, 25 and 26 are distributed between the first hanging fan 30 and the second hanging fan 34, wherein each fan blade extends from one of the hanging fan hubs 32 and 36 such that the fan blades are evenly distributed. A transverse support 40 is mounted to and rotatable with the rotatable hub 16. The transverse support 40 supports the first hanging fan 30 at a first distal mount 42 spaced radially from the rotatable hub 16 and the second hanging fan 34 at a second distal mount 44 diametrically positioned relative the first distal mount 42. The first hanging fan 30 is pivotally mounted at the first distal mount 42 and the second hanging fan 34 is pivotally mounted at the second distal mount 44. The transverse support 40 comprises parallel members 46 and 48, each passing through the rotatable hub 16, wherein the pair of hanging fans 30 and 34 are supported between the parallel members 46 and 48. Other mounting means, both including and excluding the transverse support, may be used to provide rotation of the hanging fans, or other device, about the mounting rod 18.

Figure 2:
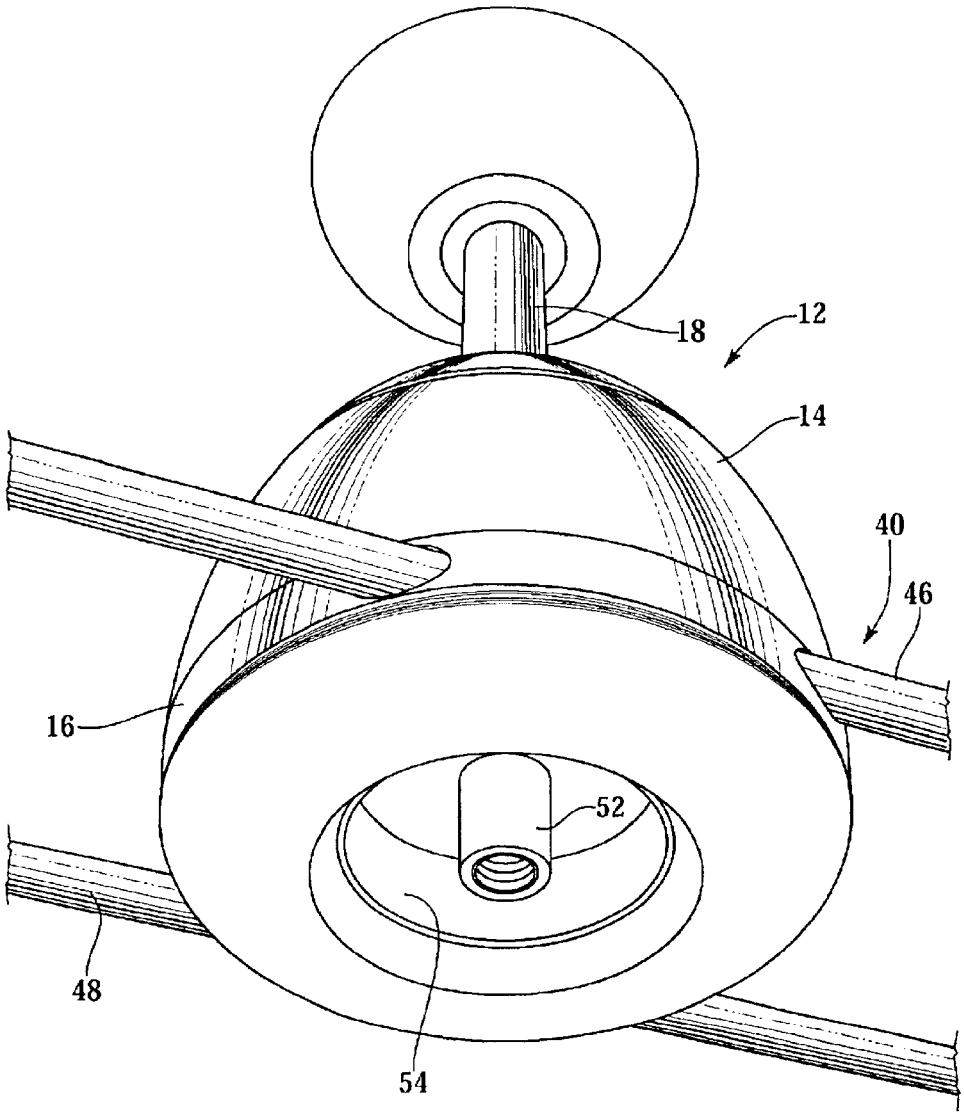
FIG. 2 shows a perspective view from below the fan hub of FIG. 1 with the light removed.

The hub 12 may comprise a light source 50. Typically the light source 50, and the hanging fans 30 and 34, are electrically powered. Such devices may be generally referred to as electrical devices. An electrical device is defined herein as a device powered by alternating current or direct current, for example, or any other conventional electrical power source. FIG. 2 shows the fan 10 with the light source 50 removed to expose a light socket 52. The light socket 52 is centrally positioned in a light well 54. The light well 54 is not connected to the rotatable hub 16, but is instead connected fixedly to the mounting rod 18, i.e., not rotating relative to the rod 18. The light well 54 is typically not directly connected to the mounting rod 18. Therefore, the rotatable hub 16 is rotatable relative to the light source 50. Conversely, when the light source 50 is mounted to and rotatably fixed to the mounting rod 18, the light source 50 is rotatable relative to the rotatable hub 16 if the mounting rod 18 is not prevented from rotating. In some applications, the light source 50 may be mounted on the transverse support 40 and rotated. Additionally, in those applications that comprise the light source 50 in the hub 12, the light source 50 does not need to be mounted below the rotatable hub 16. Furthermore, not all embodiments of the fan 10 comprise a light source 50. In some embodiments the light source 50 is removable from the light socket 52 and a removable cap (not shown) can be connected to cover the light well 54 when the light source 50 is removed.

Figure 3:
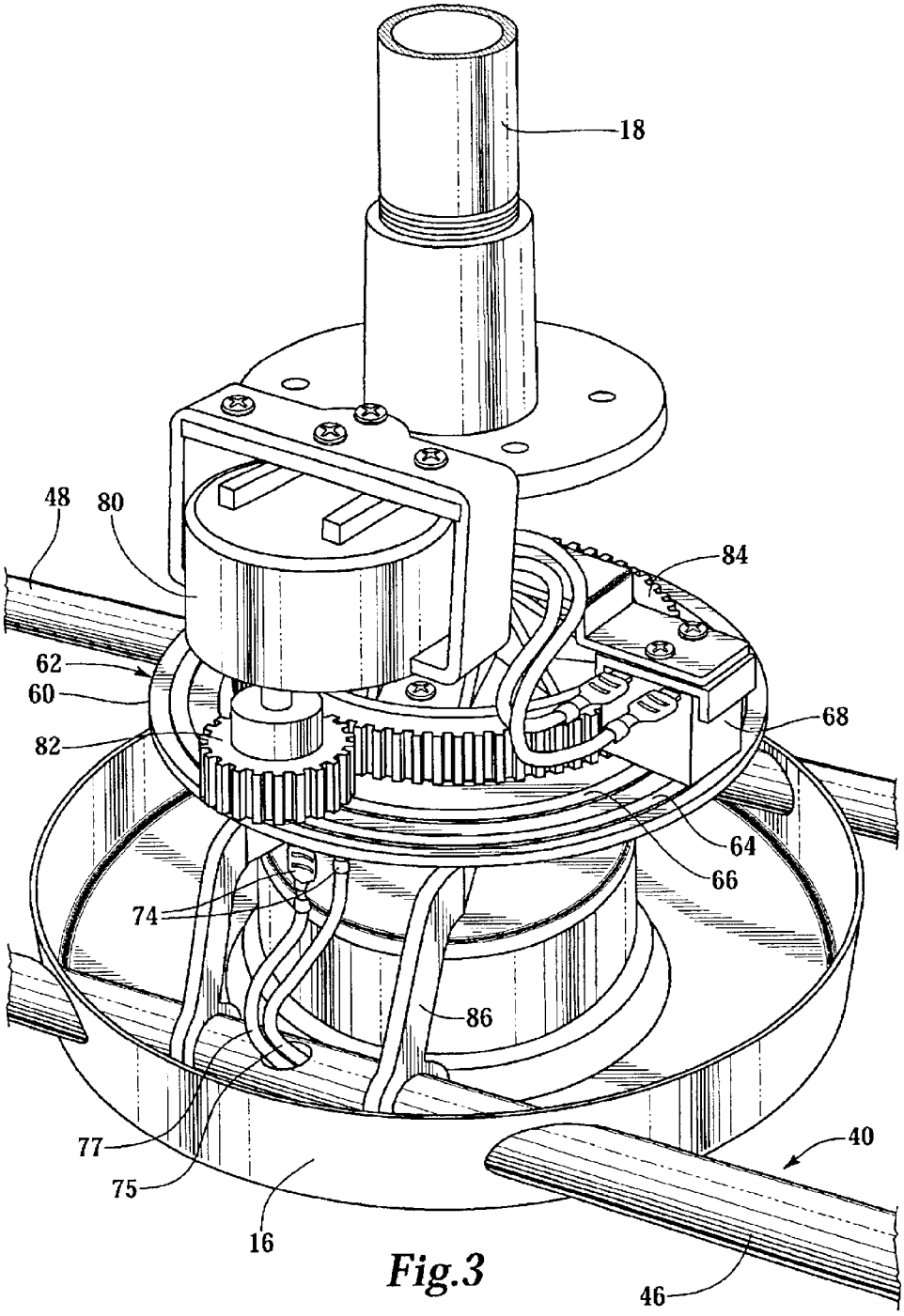
FIG. 3 shows a partial perspective view of the fan of FIGS. 1 and 2 with the housing removed to illustrate driving means and power means that, in combination, rotate the fan blades simultaneously about multiple axes.
Figure 4:
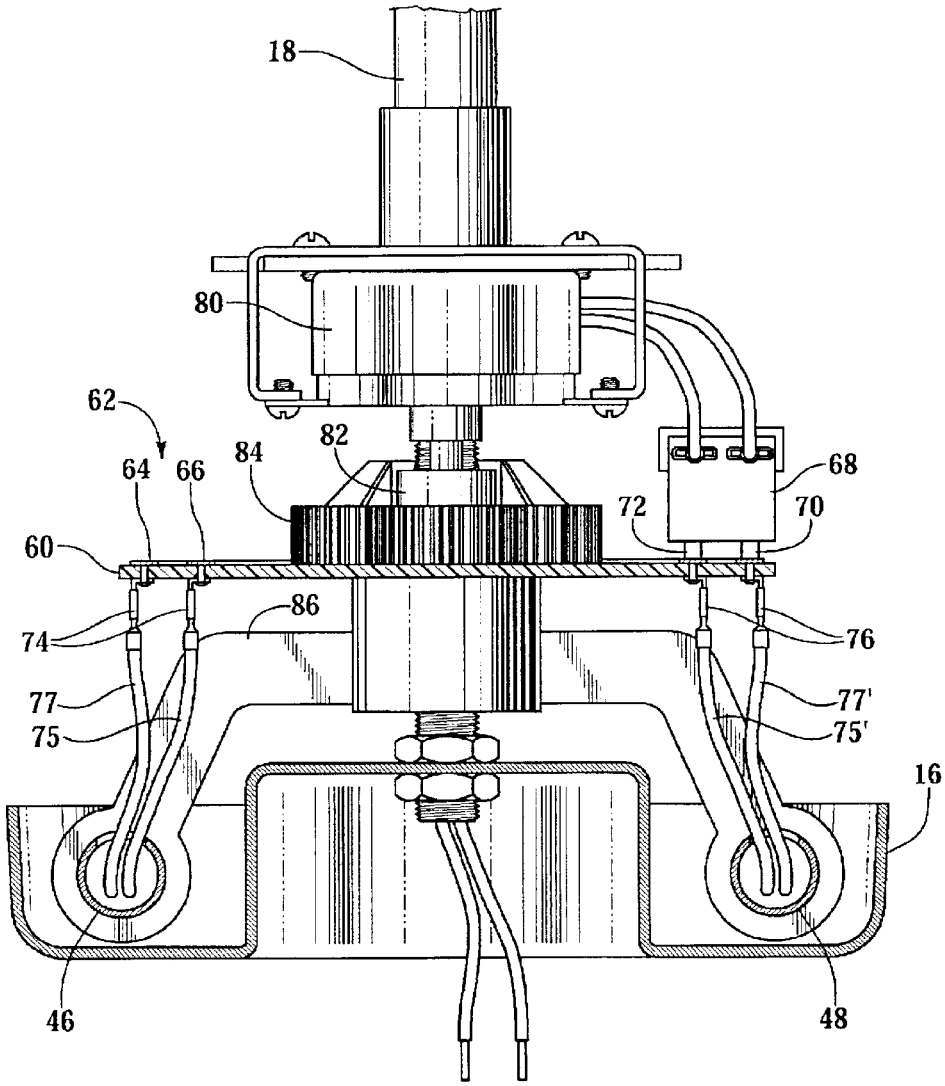
FIG. 4 shows a partial cross-section view of the hub shown in FIG. 3 looking along the hollow parallel members.
Figure 6:
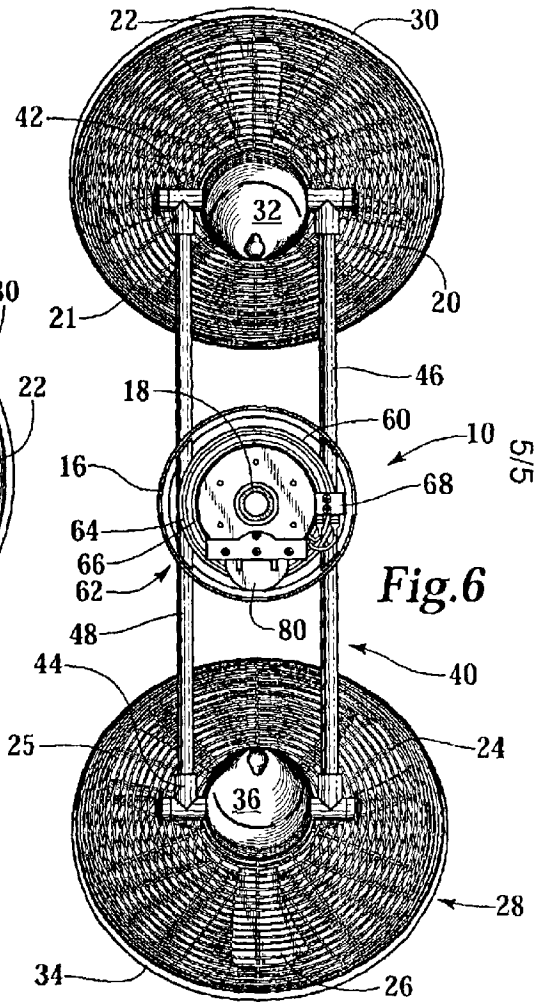
FIG. 6 shows a top view of the fan shown in FIG. 5 with the fans rotated 90 degrees relative to the hub.
Figure 5:
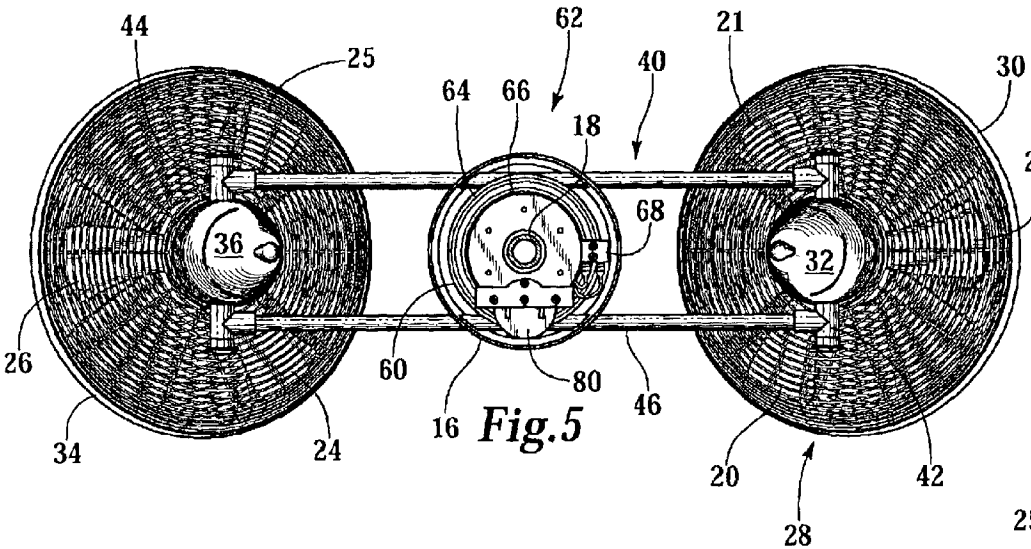
FIG. 5 shows a top view of the fan depicted in FIG. 1.

FIG. 3 shows a partial perspective view of the fan 10 with the housing 14 removed. FIG. 4 shows a partial cross-section view of the hub shown in FIG. 3 looking along the parallel hollow members. FIG. 5 shows a top view of the fan 10 in the orientation depicted in FIG. 1. FIG. 6 shows fan 10 with the fan 30 and 34 rotated 90 degrees relative to the rotatable hub 16, as compared to the view shown in FIG. 5.

FIG. 3 shows the platform 60 in the rotatable hub 16. An electrical contact track 62 is mounted to the platform 60. The electrical contact track 62 comprises first and second generally circular contacts 64 and 66 fixed to the platform 60, wherein the second generally circular contact 66 is positioned inside the first generally circular contact 64. The electrical contact track 62 is shaped based on the predefined path the fans 30 and 34 move along. In the illustrated embodiment, the fans 30 and 34 rotate in a circle. The electrical contact track 62 is circularly shaped so a power supply 68 moves along the electrical contact track 62 as the fans 30 and 34 are rotated.

In FIG. 3 the power supply 68, is adapted to be coupled to a power source and to receive power from the power source. The power supply 68 may be, for example, a battery, a voltage transformer, or other device for converting or conveying current. Such a conveying device may be a housing coupled to conventional residential electricity, for example, received from an electric utility provider. The housing may comprise contacts (also referred to herein as conductors) biased to couple the power supply 68 to the electrical contact track 62. The power supply 68 is fixably mounted to and radially spaced from the mounting rod 18. The power supply 68 is electrically coupled to the electrical contact track 62 to transfer power there through. The power supply 68 comprises a first conductor 70 and a second conductor 72 extending toward the electrical contact track 62. For some applications, the first and second conductors 70 and 72 are spring loaded conductors. When the electrical contact track 62 moves relative to the power supply 68, the first and second conductors 70 and 72 respectively contact the first generally circular contact 64 and second generally circular contact 66. The shape of the electrical contact track 62 is predetermined based on the predefined path of the hanging fans 30 and 34 so the power supply 68 first and second conductors 70 and 72 move along the electrical contact track 62 when the electrical contract track 62 moves relative to the power supply 68. The first and second conductors 70 and 72 may be biased to maintain engagement with the electrical contact track 62 during such relative movement.

First and second leads 74 and 76 are, respectively, removably connected to the first generally circular contact 64 and the second generally circular contact 66. The first and second leads 74 and 76 are thereby, respectively, electrically coupled to the first and second hanging fans 30 and 34 and to the electrical contact track 62. The electrical contact track 62 in turn couples the leads 74 and 76 to the power supply 68. Power is supplied from the power supply 68 through the electrical contact track 62 to the first and second hanging fans 30 and 34. The first lead 74, comprising a feed line 75 and a return line 77, is run along the hollow first parallel member 46 to hide the first lead 74 from an observer looking from below the fan 10. The second lead 76, also comprising a feed line 75' and a return line 77', is run along the hollow second parallel member 48 to hide the second lead 74 from an observer looking from below the fan 10. Movement of the first and second hanging fans 30 and 34 is coupled to the movement of the electrical contact track 62.

A motor 80 is fixedly mounted to the mounting rod 18. The motor 80 is coupled to and drives a driving wheel 82 such that the driving wheel 82 rotates about an axis radially spaced from the mounting rod 18. On some applications the motor 80 is aligned with the mounting rod 18. The driving wheel 82 is coupled to a hub wheel 84 rotatably fixed to the platform 60. Therefore, the rotation of the driving wheel 82 drivingly rotates the rotatable hub 16, including the platform 60 and electrical contact track 62 fixed thereto. The hub wheel 84, the first and second hanging fans 30 and 34, and the electric contact track 62 are maintained in a fixed relation, wherein operating the motor 80 rotates the hanging fans 30 and 34 about the mounting rod 18 and moves the power supply 68 along the electrical contact track 62. The driving wheel 82 is shown as a gyro gear and the hub wheel 84 is a gear sized larger than the gyro gear. The motor 80 is maintained in alignment with the driving wheel 82 so that the teeth of the driving wheel 82 and the hub wheel 84 mesh. It will be apparent to those of skill in the art to vary the driving wheel and hub wheel radii and the motor rotation per minute, for example, to select the desirable rates for rotating the rotatable hub 16. Furthermore, the motor 80 may have one or more multiple rotation rate settings in addition to an off setting. Turning off the motor 80 stops rotation of the rotatable hub 16 and thereby provides angular control in a plane transverse to the mounting rod 18. Typically, the transverse plan is perpendicular to the mounting rod 18. In other embodiments the rotatable hub 16 rotates freely after the motor 80 is turned off.

In some applications, an apparatus according to the invention comprises the mounting rod 18 and a rotatable hub 16 rotatably mounted on the mounting rod 18. The rotatable hub 16 comprises a platform 60 and an electrical contact track 62 which comprises first and second generally circular contacts 64 and 66, wherein the contacts are fixed to the platform 60. A central wheel (more generally a hub wheel) 84 is fixed relative to the platform 60 and aligned with the electrical contact track 62. A transverse support 40 is mounted to and rotatable with the rotatable hub 16 and is also mounted perpendicular to the mounting rod 18. The transverse support 40 comprises first and second distal mounts 42 and 44 that are spaced radially from the rotatable hub 16. First and second electrical devices are respectively mounted at the first and second distal mounts 42 and 44. First and second leads 74 and 76 are respectively connected to the first and second electrical devices and to the first and second generally circular contacts 64 and 66. A power supply 68 is fixedly mounted to the mounting rod 18. The power supply 68 comprises first and second conductors 70 and 72 that are spaced radially from the mounting rod 18 and respectively contact the first and second generally circular contacts 64 and 66. A drive wheel 82 is spaced radially from the mounting rod 18 and is drivingly coupled to the rotatable hub 16 through the central wheel 84. A motor 80 is fixedly mounted to the mounting rod 18 to drive the drive wheel 82. Thus, the first and second electrical devices are capable of receiving power from a fixedly mounted power supply 68 while the electrical devices are rotated about the mounting rod 18 as the fixedly mounted motor 80 causes the rotatable hub 16 to rotate. The apparatus may further comprise a third electrical device mounted below the rotatable hub platform 60, wherein the device receives power through the mounting rod 18. In some embodiments, the electrical device mounted below the rotatable hub is rotationally fixed relative to the mounting rod 18.

For some embodiments, the fan comprises a rotatable hub 16 that supports a plurality of fan blades 28. The rotatable hub comprises a hub wheel 84 rotatable about an axis. A motor 80 is radially offset from the axis and rotationally fixed. A drive wheel 82 is also radially offset from the axis and is coupled to the motor 80. The drive wheel 82 may, for example, be positioned below a motor housing and driven by a motor shaft extending the motor housing. When driven by the motor 80, the drive wheel 82 drives the hub wheel 84 causing the rotatable hub 16 to rotate. When the rotatable hub 16 rotates, the plurality fan blades 28 rotate and air is circulated. The rotatable hub 16 comprises a bracket 86 rotatably fixed relative to the hub wheel 84. The mounting rod 18 passes through the hub wheel 84 and the bracket 86. The bracket 86 supports a transverse support 40 which comprises a pair of parallel members 46 and 48. The transverse support 40 supports first and second hanging fans 30 and 34 comprising the plurality of fan blades 28. Another electrical device, a light for example, is fixedly mounted to the mounting rod 18 and positioned between the pair of parallel members 46 and 48 and the pair of hanging fans 30 and 34.

In some applications, the fan is remote controlled. See for example, U.S. Pat. Nos. 6,015,274; 5,689,261; and 5,559,406; which are incorporated herein by reference in their entirety. Although the use of remote controls to operate fans is well known in the art, the present invention builds on those known methods to provide novel remote control features not previously conceived. For clarity and brevity, details of remote control programming and operation are omitted as a variety of known techniques are available to provide basic remote control functionality. FIG. 1 schematically illustrates controlling a ceiling fan 10 with a remote control 100. For some applications, a user operates the remote control 100 to control, from a remote location, the rotation of the hanging fans 30 and 34 about the mounting rod 18. The remote location may be, for example, from a position not conveniently close to the fan 10, such as a couch or when the fan 10 is suspended out of reach. The remote control 100 is adapted to transmit a signal 102, for example IR or RF, to a receiver 104 coupled to the motor (not shown in FIG. 1). The receiver 104 may be conveniently located on the mounting rod 18 or on the stationary hub 12. The term mounting rod should be generally construed to refer to various components of a down rod assembly and cap, unless indicated otherwise. Upon operation of the main fan controls 110, the remote control 100 transmits a signal 102 to the receiver 104 coupled to the motor. In some applications, the signal format, or valve, or device identifier, are selected from a database upon operation of a key in the remote control. The motor is responsive to remote control signals 102 for affecting operation of the motor. The motor causes the rotatable hub 16 to rotate. The transverse support 40 is mounted to and rotatable with the rotatable hub 16 and is also mounted perpendicular to the mounting rod 18. The transverse support 40 supports the first and second hanging fans 30 and 34. Thus, by controlling the motor, rotation of the hanging fans 30 and 34 about the mounting rod 18 is selectively controlled. For convenience, the direction in which the hanging fans 30 and 34 are rotating about the mounting rod 18 can be reversed manually. In other embodiments, the rotation direction reverses each time the motor is powered on. Also, the fan blades rotating about each hanging fan hub can be reversed and the speed adjusted (i.e., the fan blades can be controlled) via remote control.

For some applications, the remote control 100 is adapted to control operation of the hanging fans 30 and 34 separately from controlling rotation of the hanging fans 30 and 34 about the mounting rod 18. Upon operation of the secondary fan controls 120, the remote control 100 transmits a signal 102 to the receiver 104, which is coupled to a power supply. The power supply is responsive to the remote control signal 102 for affecting the power supply. The hanging fans 30 and 34 are coupled to the receiver 104 and are responsive to signals for operating the hanging fans.

In some applications, the receiver 104 is adapted to relay signals 102 from the remote control 100 to the motor, to control rotation of the hanging fans 30 and 34 about the mounting rod 18, and to relay signals 102 from the remote control 100 to the power supply, to control operation of the hanging fans 30 and 34. Thus, a single remote control 100 is used to control fan 10 operations through a single receiver 104 which is coupled to the various subsystems.

In some applications, the fan 10 controlled by the remote control 100 has a light source 50 mounted to the mounting rod 18. The receiver 104 is mounted to the mounting rod 18 and is coupled to the light source 50. Upon operation of light control keys 130, the remote control 100 transmits a signal 102 to the receiver 104, which is adapted to receive the signal 102. The light source 50 is responsive to the received signal 102. Upon receiving the signal 102 from the remote control 100, light source 50 increases in intensity based on the number of pulses received. The light source 50 may be adapted to step through a cycle of operation settings, such as low-medium-hi-off, and repeating the cycle. Thus, the same pulse signal, associated with the light source 50, can be sent from the remote control and the light source 50 will advance through operation settings. Alternatively, specific control signals respectively associated with specific operations may be sent from the remote control 100. The motor and power supply may be adapted to operate in similar manners to those discussed with respect to the light source 50. Furthermore, a wall mount system may be used in conjunction with the remote control 100, or in alternative to the remote control 100, to fully and independently control the rotation speeds of the rotatable hub 16 and the hanging fans 30 and 34.

While the present invention has been described with reference to one or more particular embodiments, those skilled in the art will recognize that many changes may be made thereto without departing from the spirit and scope of the present invention. Each of these embodiments, and obvious variations thereof, is contemplated as falling within the spirit and scope of the claimed invention, which is set forth in the following claims.

What is claimed is:

1. A fan comprising:

a mounting rod;

a rotatable hub rotatably mounted on the mounting rod;

a motor mounted to the mounting rod and driving the rotatable hub;

a plurality of fan blades coupled to and rotatable with the rotatable hub;

a power supply mounted to the mounting rod and electrically coupled to an electrical contact track, wherein the electrical contact track rotates relative to the power supply; and an electrical device rotatable with the rotatable hub and electrically coupled to the electrical contact whereby the electrical device receives power from the power supply.

2. The fan of claim 1, wherein the rotatable hub comprises a platform comprising the electrical contact track.

3. The fan of claim 2, wherein the platform electrical contact track is generally circular.

4. The fan of claim 3, wherein the power supply comprises a conductor contacting the electrical contact track.

5. The fan of claim 4, wherein the electrical device is a light source.

6. The fan of claim 4, comprising a transverse support mounted to and rotatable with the rotatable hub, wherein the transverse support comprises a distal mount spaced radially from the rotatable hub and the electrical device is mounted at the distal mount.

7. The fan of claim 6, wherein the electrical device comprises a hanging fan comprising a banging fan hub and the plurality of fan blades extending from the hanging fan hub.

8. The fan of claim 7, comprising a drive wheel spaced radially from the mounting rod, wherein the motor drives the drive wheel and the drive wheel drives the rotatable hub.

9. The fan of claim 8, wherein the rotatable hub comprises a central wheel rotatably fixed relative to the platform, wherein the drive wheel drives the central wheel.

10. The fan of claim 9, wherein the drive wheel is a gyro gear and the central wheel is a gear sized larger than the gyro gear.

11. The fan of claim 1, comprising:

a drive wheel spaced radially from the mounting rod;

a central wheel rotatably fixed relative to the electrical contact track; and wherein the motor drives the drive wheel and the drive wheel drives the central wheel, whereby the rotatable hub is rotated.

12. The fan of claim 11, comprising a transverse support mounted to and rotatable with the rotatable hub, wherein the transverse support comprises a distal mount spaced radially from the rotatable hub and the electrical device is mounted at the distal mount.

13. The fan of claim 1, wherein the power supply is adapted to be coupled to a power source to receive current from the power source.

14. The fan of claim 1, comprising:

a receiver, wherein the receiver is adapted to receive a signal for controlling the motor from a remote control and the motor is adapted to be responsive to the signal, whereby rotation of the electrical device about the mounting rod may be controlled.

15. The fan of claim 14, wherein the receiver is coupled to the power supply and adapted to receive a signal from a remote control to control operation of the electrical device, and wherein the power supply is responsive to the signal to control operation of the electrical device, whereby the electrical device may be positioned and operated remotely.

16. The fan of claim 1, comprising:

a light source mounted to the mounting rod;

a receiver mounted to the mounting rod and coupled to the light source, wherein the receiver is adapted to receive a signal from a remote control and wherein the light is responsive to the received signal.

17. The fan of claim 16, wherein the light is adapted to advance a step in a series of light intensity steps.

18. A fan comprising:

a mounting rod;

a rotatable hub rotatably mounted on the mounting rod;

a motor radially offset from the axis and rotationally fixed;

a drive wheel radially offset from the axis, driven by the motor, and coupled to a hub wheel, wherein the drive wheel drives the hub wheel and causes the rotatable hub to rotate;

a plurality of fan blades supported by the rotatable hub, wherein the plurality of fan blades rotate when the rotatable hub rotates;

a transverse support supported by the rotatable hub; and a pair of hanging fans diametrically supported by the transverse support, wherein the pair of hanging fans comprise the plurality of fan blades.

19. The fan of claim 18, wherein the rotatable hub comprises a bracket rotatably fixed relative to the hub wheel, wherein the bracket supports the transverse support.

20. The fan of claim 19, wherein the mounting rod passes through the hub wheel and the bracket.

21. The fan of claim 19, wherein the transverse support comprises a pair of parallel members supporting the pair of hanging fans.

22. The fan of claim 21, comprising an electrical device fixedly mounted to the mounting rod and positioned between the pair of parallel members and the pair of hanging fans.

23. The fan of claim 18, comprising an electrical device fixedly mounted to the mounting rod and positioned between the pair of hanging fans.

24. The fan of claim 23, wherein:

the electrical device is a light source responsive to control signals associated with controlling the light source;

the first and second hanging fans are responsive to control signals associated with controlling hanging fans; and a receiver is mounted to the mounting rod and is coupled to the hanging fans and the light source, wherein the receiver is adapted to receive control signals from a remote control.

25. The fan of claim 18, comprising:

an electrical contact track rotatably fixed relative to the hub wheel;

a pair of leads respectively connecting the pair of hanging fans to the electrical contact track; and a power supply fixedly mounted to the mounting rod and contacting the electrical contact track, wherein the track rotates relative to the power supply and the power supply moves along the track when the rotatable hub rotates.

26. The fan of claim 18, comprising:

a receiver coupled to the motor, wherein the receiver is adapted to receive a signal from a remote control to control the motor, whereby rotation of the pair of hanging fans is controlled.

27. A system comprising:

a mounting rod;

a rotatable hub rotatably mounted on the mounting rod;

a power supply rotatable relative to the rotatable hub;

an electric contact track attached to a rotatable platform; and a pair of hanging fans supported by the rotatable hub, wherein each is electrically connected to the electric contact track.

28. The system of claim 27, comprising:

a motor fixed to the mounting rod and coupled to rotate the rotatable hub;

a receiver coupled to the power supply and the motor;

a light source mounted on the mounting rod below the rotatable hub and coupled to the receiver; and wherein the receiver is adapted to receive signals from a remote control to affect operation of the power supply, the motor, and the light source.

29. The system of claim 28, comprising a remote control adapted to transmit signals for controlling the power supply, the motor, and the light source.

* * * * *

UNITED STATES PATENT AND TRADEMARK OFFICE

CERTIFICATE OF CORRECTION

PATENT NO. : 6,832,902 B2
APPLICATION NO. : 10/172189
DATED : December 21, 2004
INVENTOR(S) : Mark Gajewski et al.

It is certified that error appears in the above-identified patent and that said Letters Patent is hereby corrected as shown below:

| | |
|---|---|
| Column 8, line 9, | Delete "a banging fan hub" |
| Claim 7 | Replace With --a hanging fan hub-- |

Signed and Sealed this

Twenty-ninth Day of May, 2007

JON W. DUDAS
*Director of the United States Patent and Trademark Office*